United States Patent [19]

Johnson

[11] Patent Number: 4,790,134

[45] Date of Patent: Dec. 13, 1988

[54] OUTBOARD MOTOR EXHAUST TUBE DIVIDER

[75] Inventor: Clemens A. Johnson, Oshkosh, Wis.

[73] Assignee: Brunswick Corporation, Skokie, Ill.

[21] Appl. No.: 61,904

[22] Filed: Jun. 11, 1987

[51] Int. Cl.[4] ..... F01N 3/02

[52] U.S. Cl. ..... 60/321; 440/89

[58] Field of Search ..... 60/310, 321, 320, 313; 440/89

[56] References Cited

U.S. PATENT DOCUMENTS

| | | | |
|---|---|---|---|
| 3,217,696 | 11/1965 | Kiekhaefer | 440/89 |
| 3,808,807 | 5/1974 | Lanpheer . | |
| 3,813,880 | 6/1974 | Reid et al. . | |
| 4,145,988 | 3/1979 | Harada | 440/89 |
| 4,187,809 | 2/1980 | Lanpheer | 60/313 |
| 4,346,676 | 8/1982 | Tyner . | |
| 4,731,995 | 3/1988 | McFarland | 60/313 |

*Primary Examiner*—Douglas Hart

*Attorney, Agent, or Firm*—Andrus, Sceales, Starke & Sawall

[57] ABSTRACT

A divider (25, 22) is integrated into the upper end of an outboard motor exhaust tube (17) so that the exhaust discharging from a pair of engine ports (12*a*) remains separated for a portion of its downward travel through the tube. The divider separates the exhaust tube itself into multiple individual channels. More specifically, a longitudinally extending vertical plate (25) is disposed within the exhaust tube and extends thereacross. The opposed vertical plate edges are anchored to the vertical exhaust tube walls (18, 19). In the present embodiment, a longitudinally extending cooling tube housing (22) effectively forms part of one of the exhaust tube walls (18) and with the housing itself forming part of the divider.

2 Claims, 2 Drawing Sheets

OUTBOARD MOTOR EXHAUST TUBE DIVIDER

U.S. PRIOR ART OF INTEREST

| U.S. Pat. No. | Inventor | Issue Date |
|---|---|---|
| 3,808,807 | Lanpheer | May 7, 1974 |
| 3,813,880 | Reid et al | June 4, 1974 |
| 4,346,676 | Tyner | August 31, 1982 |

BACKGROUND AND SUMMARY OF THE INVENTION

This invention relates to an outboard motor exhaust tube divider, and particularly to the exhaust system for a two-cycle crankcase compression water cooled V-engine for use in outboard motors.

Such engines, as for example the engine disclosed in U.S. Pat. No. 4,346,676, are normally disposed in the upper unit of an outboard motor and include an exhaust manifold which discharges exhaust gases from a pair of ports downwardly into the usual lower unit and hence through a passage in the propeller to the water. The engines also include a cooling water discharge arrangement for disposing of the cooling water through the lower unit.

An exhaust tube is suitably mounted in the lower unit and provides a single common passage which communicates between the engine exhaust ports and the propeller passage. In some engines of the type under consideration here, the exhaust tube has included an integrally formed rib-like internal housing in its upper end portion. The housing extends inwardly from the tube wall, and furthermore extends from the upper exhaust tube terminus and longitudinally downwardly for a limited distance. The housing forms a channel which opens outwardly through the exhaust tube wall, and which receives a cooling water tube which carries the water from the engine downwardly for discharge.

The above-described construction is such that the upper end of the exhaust tube is partially obstructed by the internal housing.

It has been noted that outboard motors constructed as described above have not performed particularly well at the low end. That is, while the motors have exhibited excellent performance characteristics at high engine speeds, their horsepower has been somewhat below par at low engine speeds, such as about 4000 rpm to 5500 rpm. This has been detrimental to the ability to provide relatively fast acceleration of large boats.

This lack of low end performance has been substantially solved in some prior outboard motors by providing a pair of megaphones which have been mounted to an in-line cylinder engine and which have extended downwardly from the respective manifold discharge ports into the exhaust tube, resulting in fine tuning of the engine. See U.S. Pat. Nos. 3,808,807 and 3,813,880. However, the use of such megaphones in association with the V-type engine described above has not been economically feasible heretofore, due to the obstruction of the exhaust tube by the internal rib-like housing.

It is an object of the present invention to raise the low end performance of an outboard motor engine, even though the exhaust tube upper end is partially obstructed, and in a manner which is simple and economical from a manufacturing standpoint, and without sacrificing high end engine performance.

Broadly in accordance with the various aspects of the invention, divider means is integrated into the upper end of the exhaust tube so that the exhaust discharging from the pair of engine manifold ports remains separated for a portion of its downward travel through the tube. The divider means separates the exhaust tube itself into multiple individual channels. More specifically, a longitudinally extending vertical plate is disposed within the exhaust tube and extends thereacross. The opposed vertical plate edges are anchored to the vertical exhaust tube walls. In the present embodiment, the longitudinally extending cooling tube housing effectively forms part of one of the exhaust tube walls, and with the housing itself forming part of the divider means.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figure 1:
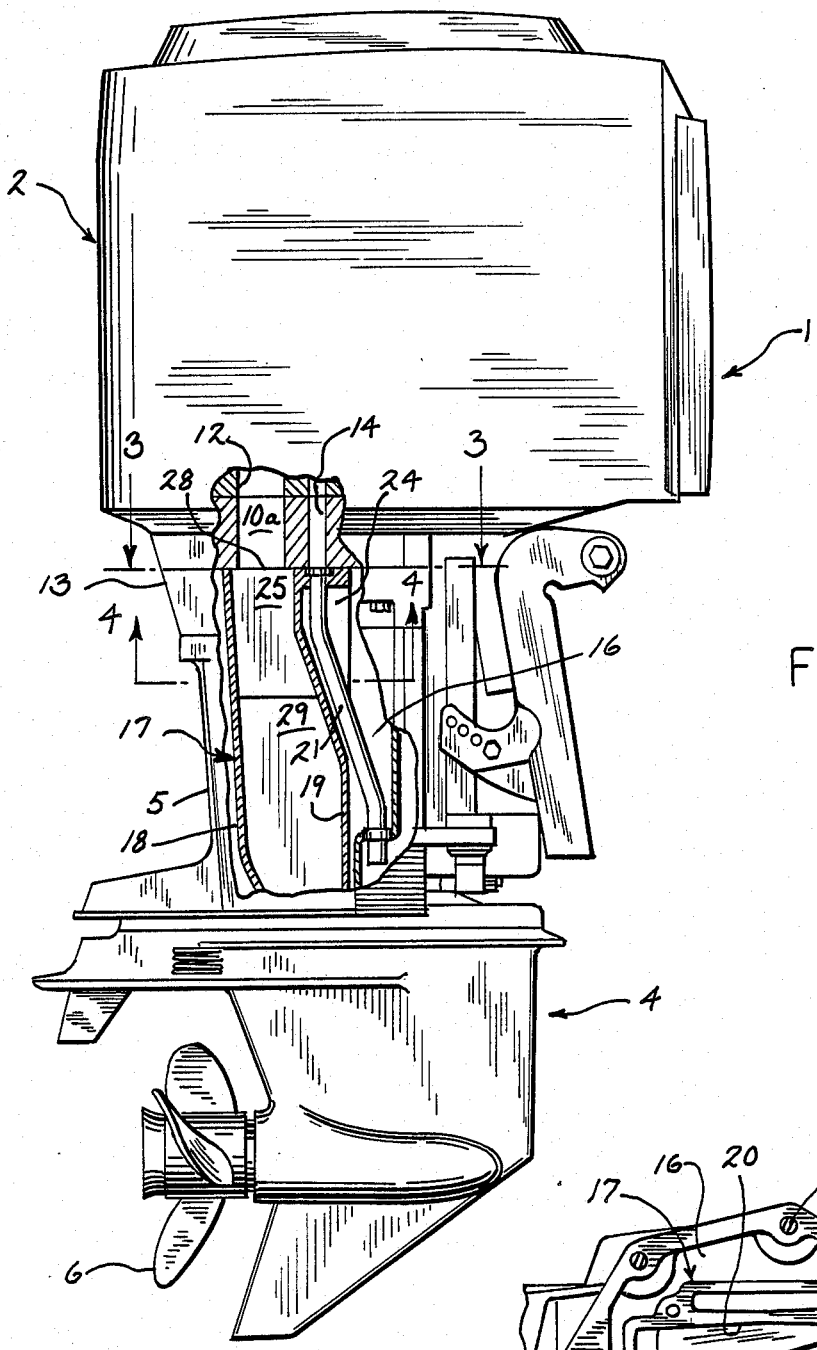
FIG. 1 is a side elevation of an outboard motor incorporating the aspects of the present invention, with parts broken away.
Figure 3:
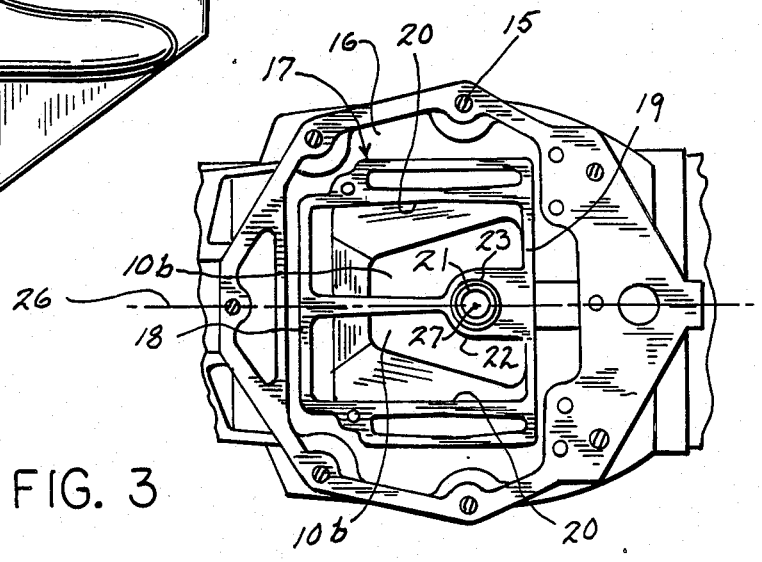
FIG. 3 is a transverse section taken on line 3—3 of FIG. 1.
Figure 2:
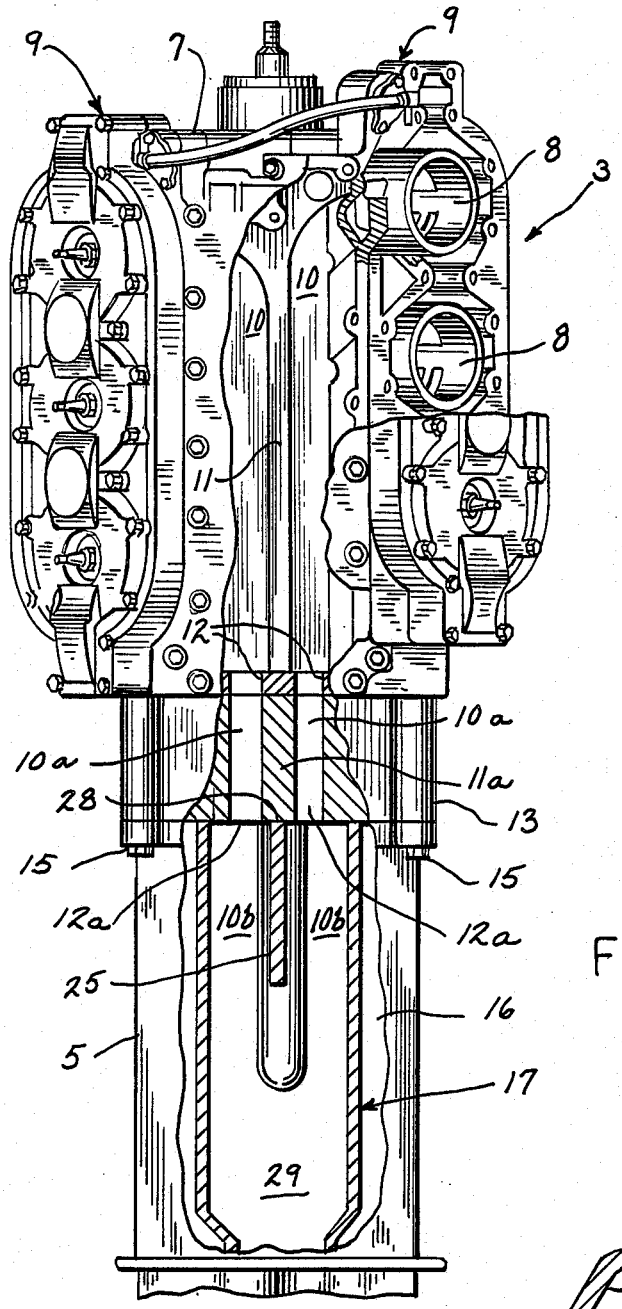
FIG. 2 is a fragmentary broken away rear view of the upper portion of the outboard motor.
Figure 5:
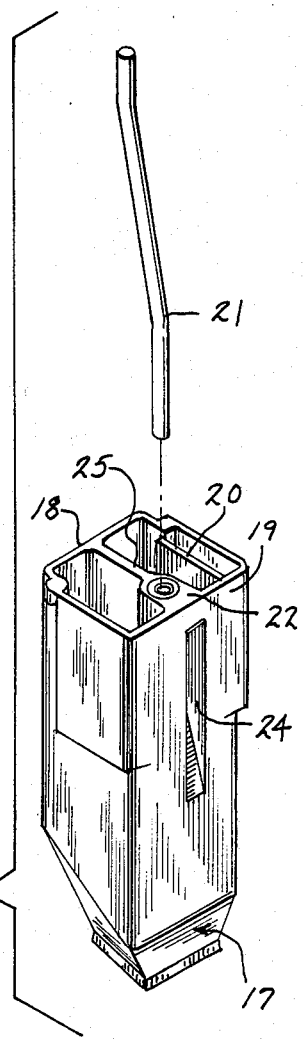
FIG. 5 is an exploded perspective view of the exhaust tube and cooling water intake tube.
Figure 4:
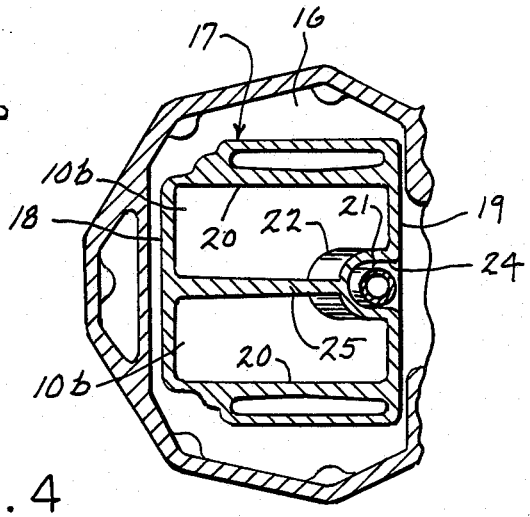
FIG. 4 is a transverse section taken on line 4—4 of FIG. 1.

As shown in the drawings, the aspects of the invention are adapted to be embodied in an outboard motor 1 having an upper unit 2 including a two-cycle water cooled internal combustion V-engine 3, and a lower unit 4 mounted to said upper unit and including a drive shaft housing 5 and a suitably driven propeller 6.

Engine 3 is generally similar to that disclosed in U.S. Pat. No. 4,346,676 which is incorporated herein by reference, and includes a cylinder block 7 having six cylinders 8 arranged in two banks 9 forming a V, the two banks being vertically offset. Block 7 is provided with a tuned exhaust system which connects the exhaust port of each cylinder in each bank 9 to a corresponding one of a pair of exhaust gas chambers 10. The pair of chambers 10 are separated by a web 11 and in turn open downwardly through a pair of corresponding side-by-side manifold ports 12 at the bottom of block 7 for ultimate discharge of exhaust into lower unit 4.

An adapter 13 may be interposed between engine block 7 and drive shaft housing 5, and effectively forms a downward extension of the block as well as downward extensions **10*a* of exhaust gas chambers 10 and a downward extension 11*a* of web 11, forming ports 12*a***.

Engine 3 also includes the usual cooling jacket (not shown) which terminates in a cooling water intake port 14, shown here at the base of adapter 13.

Drive shaft housing 5 may be secured to block 7 as by bolts 15 which in this instance pass through adapter 13.

Drive shaft housing 5 forms a chamber 16 within which a longitudinal downwardly extending exhaust tube 17 is suitably mounted in any well-known manner. Exhaust tube 17 is shown as generally rectangular, having opposed rear and front walls 18, 19 respectively as well as side walls 20. Exhaust tube 17 is adapted to communicate between engine exhaust openings 12*a* and a discharge passage (not shown) disposed in propeller 6.

For purposes of carrying intake cooling water to engine 3, a water tube 21 is attached at its upper end at engine water discharge port 14, with water tube 21 extending downwardly into drive shaft housing 5. For purposes of accommodating water tube 21, a rib-like elongated downwardly longitudinally extending housing 22 is disposed within the upper end portion of exhaust tube 17. Housing 22 is shown as being integral with and extending transversely inwardly of front wall 19 toward rear wall 18. Furthermore, housing 22 extends generally axially downwardly from the upper exhaust tube terminus, and then tapers outwardly towards wall 19, where its lower end is positioned within the exhaust tube. Housing 22 forms an upper sleeve portion 23 which merges into an outwardly facing lower open channel 24 formed in exhaust tube wall 19. The upper end of water tube 21 is received within sleeve portion 23, and then follows the contour of the housing downwardly within channel 24, until it escapes exhaust tube 17 through wall 19 and continues downwardly within chamber 16.

As previously discussed, it is desired to increase the low end performance of an engine and exhaust system of the type just described, and yet the obstructive nature of housing 22 within exhaust tube 17 prevents the utilization of engine-mounted megaphones which are disposed within the exhaust tube.

In accordance with the various aspects of the invention, divider means is integrated into the upper end portion of exhaust tube 17 so that the exhaust discharging from engine ports 12, 12*a* remains separated in a multiplicity of individual channels for a portion of its downward travel through tube 17. For this purpose, and in the present embodiment, an elongated longitudinally extending divider plate 25 is disposed within the upper end of exhaust tube 17, and extends thereacross in a generally transverse plane 26 containing the longitudinal axis 27 of sleeve 23. Plate 25 is disposed so that, when exhaust tube 17 is mounted to engine 3, plate 25's upper terminus edge 28 is aligned with and abuts (or is in sealing relationship with) the lower end of web 11, 11*a*.

Furthermore, the rear vertical edge of plate 25 is anchored to the inner face of exhaust tube wall 18, while the front vertical edge of plate 25 is anchored to exhaust tube wall 19 through housing 22, which effectively forms part of wall 19.

Divider plate 25 may be formed integral with the exhaust tube assembly, and may be planar or contoured if desired.

Plate 25 continues the downward extent of exhaust passageways from engine 3, as at channels 10*b*, with the exhaust finally discharging into a common passageway 29 below plate 25. The result is to tune engine 3 to improve its low end performance, all at a fraction of the cost of a megaphone system. It has been found that at about 4000 rpm, engine horsepower may be increased as much as 20–25 hp.

Various modes of carrying out the invention are contemplated as being within the scope of the following claims particularly pointing out and distinctly claiming the subject matter which is regarded as to the invention.

I claim:

1. An outboard motor comprising, in combination:

(a) an upper unit (2) having an internal combustion engine (3) and with said engine having a pair of side-by-side exhaust ports (12; 12*a*) separated by a web (11; 11*a*), (b) a lower unit (4) mounted to said upper unit and with said lower unit including a drive shaft housing (5) and a propeller (6) driveable by said engine, (c) a longitudinally extending exhaust tube (17) disposed within said housing and with said exhaust tube adapted to provide for passage of exhaust from said exhaust ports downwardly toward said propeller, (d) divider means integrated into and forming a part of the upper end portion of said exhaust tube for separating said exhaust tube into multiple individual channels (10*b*) communicating respectively with said exhaust ports, (e) said exhaust tube (17) being provided with opposed wall portions (18, 19), (f) said divider means including a longitudinally extending divider plate (25) having vertical edges anchored to said opposed wall portions, (g) said engine (3) including a cooling water intake port (14) to which a downwardly extending cooling water tube (21) is connected, (h) and an elongated longitudinal housing (22) extending inwardly within said exhaust tube (17) and effectively forming part of one of said wall portions (18, 19).

(i) said last-named housing carrying said cooling water tube, (j) one said vertical edge of said divider plate (25) being anchored to said last-named housing so that the latter forms part of said divider means.

2. The outboard motor of claim 1:

(a) in which said last-named housing (22) is rib-like and includes:

(1) an upper sleeve portion (23) defining a longitudinal axis (27), (2) and an outwardly facing lower open channel (24), (b) said divider plate (25) extending across said exhaust tube (17) in a generally transverse plane (26) containing said axis.

* * * * *